United States Patent [19]

Jeanson et al.

[11] Patent Number: 4,591,187

[45] Date of Patent: May 27, 1986

[54] BOOK RETAINING DEVICE AND METHOD OF USING SAME

[75] Inventors: Richard L. Jeanson, Watertown; John B. Olson, Waukesha, both of Wis.

[73] Assignee: Fortec, Inc., Waukesha, Wis.

[21] Appl. No.: 587,222

[22] Filed: Mar. 7, 1984

[51] Int. Cl.[4] ..... B42F 7/04; B42F 9/00; B42D 17/00

[52] U.S. Cl. ..... 281/45; 248/444.1; 281/46; 402/75; 402/502

[58] Field of Search ..... 211/45; 248/444.1, 447; 281/42, 45, 46, 47, 48, 49, 50; 402/73, 502

[56] References Cited

U.S. PATENT DOCUMENTS 1,078,354 11/1913 Jensen ..... 281/46
3,950,012 4/1976 Donovan ..... 281/46

FOREIGN PATENT DOCUMENTS 536028 3/1955 Belgium ..... 281/46
375502 6/1932 United Kingdom ..... 281/46
1190056 4/1970 United Kingdom ..... 281/46

*Primary Examiner*—Paul A. Bell
*Attorney, Agent, or Firm*—Marshall, O'Toole, Gerstein, Murray & Bicknell

[57] ABSTRACT

A device for retaining a book, such as a telephone directory, in a holder or on a flat surface, in order to prevent unauthorized removal or theft of the book. A plurality of pin-like retainer members are mounted in a pair of mounting members in laterally spaced, parallel relation. The number of retainers is determined by the thickness of the book. The pointed ends of the pin-like retainer members are shifted into the ends of the book and the assembly is secured either to the flat surface or to a support bar that is riveted or otherwise secured to the inner surface of the back of the holder. The pin-like retainers are frictionally retained either in a series of laterally spaced slots or bores in the mounting members so as not to be removable therefrom without the use of a tool and a substantial amount of force.

13 Claims, 11 Drawing Figures

BOOK RETAINING DEVICE AND METHOD OF USING SAME

BACKGROUND OF THE INVENTION (1) Field of the Invention

This invention relates to book retaining devices, and more particularly relates to a device for retaining and preventing unauthorized removal of a telephone directory from a holder therefor and to a method of using the device.

(2) Description of the Prior Art

Holding and retaining devices have been heretofore advanced for supporting and retaining books, such as telephone directories, in an area of use so that the directories can be shifted from an unobtrusive, storage position to a position where the pages of the directory may be conveniently viewed by a user. An example of a telephone directory holder for accomplishing the foregoing objectives is disclosed in U.S. Pat. No. 3,860,212 to Nawman.

Supporting devices for supporting catalogs, telephone directories and the like on a horizontal support surface, for use by the public and which prevent unauthorized removal of the book from the support surface, have also been developed. An example of a book support attachment which permits a telephone directory or the like to be swung between a usable position resting on the top of a cabinet structure, or to a stored position within the cabinet, is disclosed in U.S. Pat. No. 2,612,427 to Faulkner et al.

The book support attachment disclosed in the Faulkner et al patent also includes a plurality of laterally spaced rods, which extend longitudinally through the gutters of the book in spaced relation to the back thereof and which are usually effective to prevent unauthorized removal of the book from the attachment and support. While the rods employed in the attachment of the Faulkner et al patent, and similar devices, discourage removal of an associated book from the device and an area of use, with effort, the restraining rods can be disengaged from the associated book and the latter thereafter misplaced or stolen. Moreover, book restraining rods such as are employed in the Faulkner et al patent frequently covered portions of the printing, which is undesirable. In addition, it was usually tedious and time consuming to disengage the rods from and reengage the rods with the book, whenever it became necessary to remove and/or replace a book that was previously engaged with a device such as the Faulkner et al attachment.

SUMMARY OF THE INVENTION

Briefly described, in its broader aspects, the present invention contemplates a device for releasably retaining a book on a flat surface to prevent unauthorized removal therefrom. In its more specific aspects, the present invention contemplates a novel retaining device for releasably retaining one or more telephone directories in a holder having a plate-like back and covers that are hingedly connected to the side edges of the back for protecting the book. The retainer, to be hereinafter described in detail, includes an elongated support member or bar, which may be secured to a flat surface on which the book is to be used or to the inner surface of the back of the holder. One or more pin-like, retainer members are mounted in a pair of mounting members, the latter being detachably secured to the ends of the support member. The pin-like retainer members have engaging portions that extend inwardly toward each other, and mounting portions that are adapted to be received and frictionally retained in recesses in the mounting members and to be removable therefrom upon the application of suitable force. The engaging portions of the retainer members are adapted to extend into the ends of a book and between the pages thereof so that the book is secured to the mounting members. Releasable securing means, such as screws having specially formed heads to prevent unauthorized removal thereof, are employed to secure the mounting members to the ends of the support member and prevent theft of the book.

In the embodiments of the invention herein disclosed, the mounting portions of the pin-like retaining members, and the recesses in the mounting members, are sized so that the retainer members cannot be removed from the mounting members by finger force. These embodiments also contemplate addition or removal of the retainer members from the mounting members in order to accommodate different thickness books.

In one embodiment, the mounting portions of the retainer members are engagable with and disengagable from the mounting members by forcing the mounting portions downwardly into or upwardly out of longitudinally extending slots in the mounting members. In another embodiment, the mounting portions of the retainer members are axially shiftable into and out of laterally spaced, longitudinally extending bores in the mounting members.

Accordingly, it is a general object of the invention to provide a novel and improved device for releasably retaining a book, such as a telephone directory, on a flat surface so that the book cannot be casually or easily removed from the retaining device or the surface on which it is mounted.

A more particular object is to provide a novel retaining device of the foregoing character, which permits rapid and simplified engagement and disengagement of different sized telephone directories with holders therefor such as are used in telephone booths and other locations where public telephones are available.

A specific object is to provide a novel retaining device of the character described, wherein a pair of mounting members having a plurality of pin-like retainer members mounted therein are utilized to prevent unauthorized removal of a book from a support surface when engaging portions of the retainer members extend into the ends of the book and the mounting members are secured to the holder.

A further object is to provide a novel retaining device of the character described, which is simple in construction, reliable and positive in operation, economical to manufacture, and which permits rapid engagement of a book with and disengagement thereof from the device in the field.

Other objects and advantages of the invention will be apparent from the following detailed description and accompanying sheets of drawings.

DESCRIPTION OF THE PREFERRED EMBODIMENTS

Figure 1:
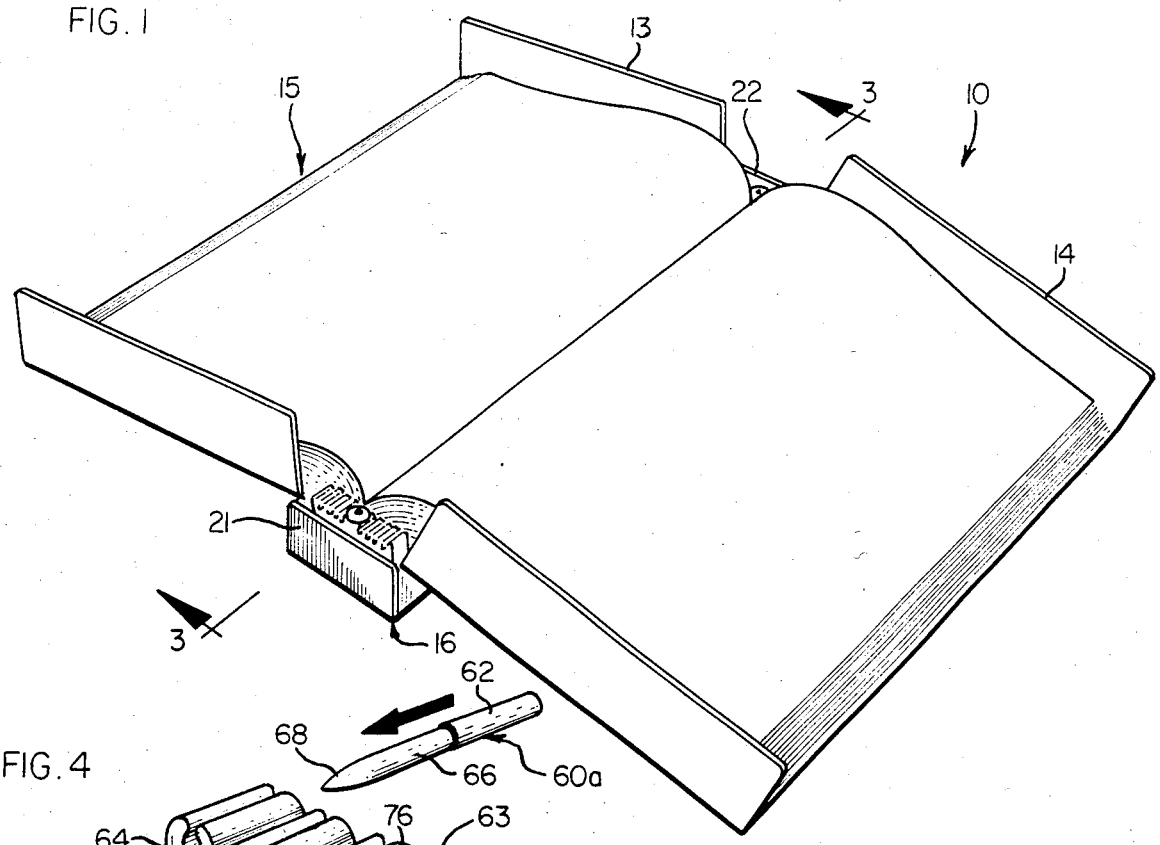
FIG. 1 is a perspective view of a telephone directory holder having a retaining device embodying the features of the present invention mounted therein and operatively engaged with a telephone directory, the covers of the holder and telephone directory being illustrated in an open position.

In FIG. 1, a telephone directory holder, indicated generally at 10, is illustrated as it would appear when the swingable covers thereof indicated at 13 and 14, respectively, are in an open position and supporting the pages of a telephone directory, indicated generally at 15. The holder 10, in the present instance, includes an elongated, channel-shaped, back portion having a plate-like web 17 (FIGS. 3 and 5) and upstanding side flanges 19 and 20 and upstanding end flanges 21 and 22. The covers 13 and 14 are hingedly connected to the upper, longitudinally extending edges of the flanges 19 and 20 as by piano-type hinges 24.

Figure 2:
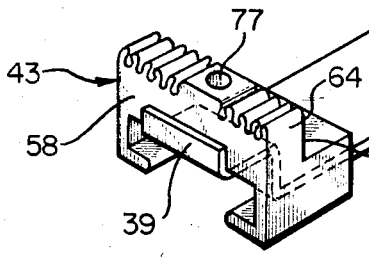
FIG. 2 is a perspective view of the retaining device of the present invention and showing the latter as it would appear prior to being mounted on a flat surface or in the telephone directory holder illustrated in FIG. 1 and prior to engaging the same with a telephone directory.
Figure 3:
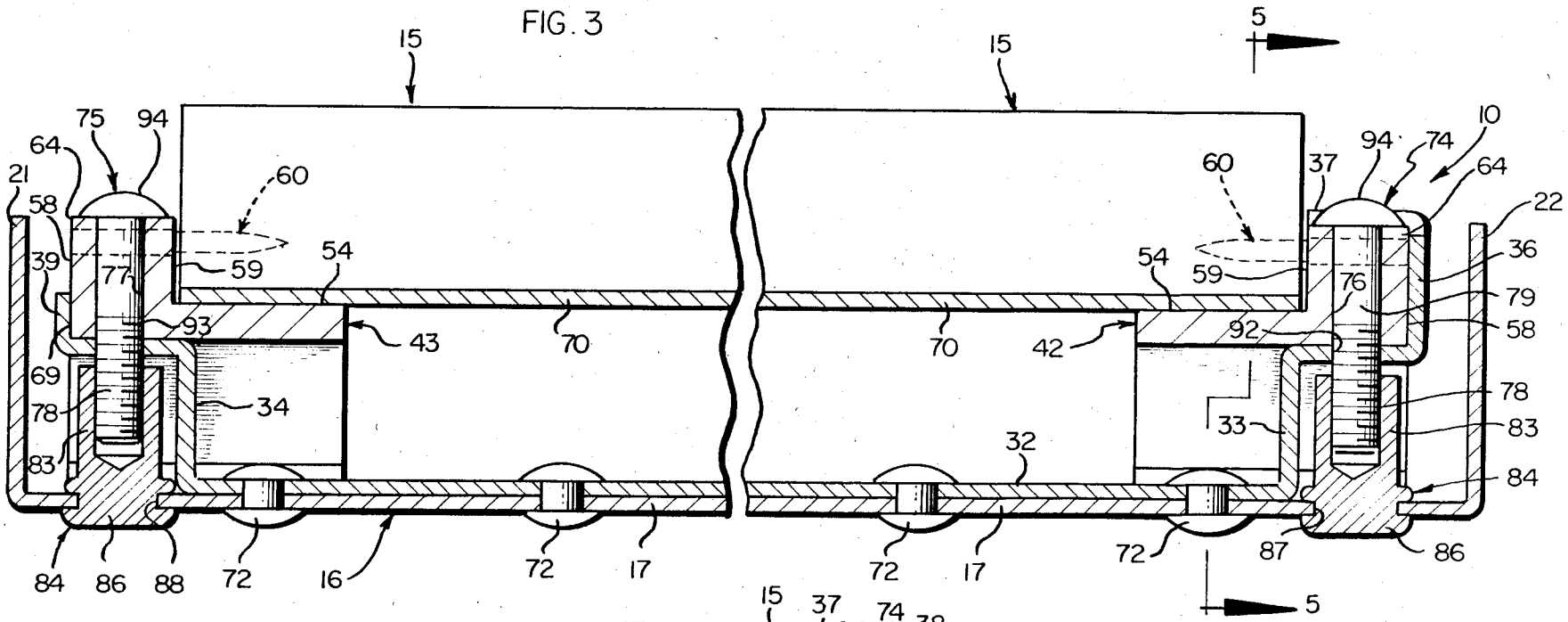
FIG. 3 is an enlarged, broken, vertical sectional view taken along the line 3—3 of FIG. 1.

Referring now to FIG. 2 in conjunction with FIG. 1, a retaining device for releasably retaining the telephone directory 15 in the holder 10 is illustrated and indicated generally at 30. The retaining device 30 comprises an elongated, plate-like support member or bar 32 having upwardly extending, generally Z-shaped end flanges 33 and 34 (FIG. 3). The end flange 33 includes an upwardly extending, longitudinally outwardly offset upper portion 36 having a pair of laterally spaced, longitudinally inwardly extending fingers 37 and 38 thereon, the purpose and function of which will be described in greater detail hereinafter.

The end flange 34 likewise has an upwardly extending, longitudinally outwardly offest portion 39 whose purpose and function will be described hereinafter.

Figure 4:
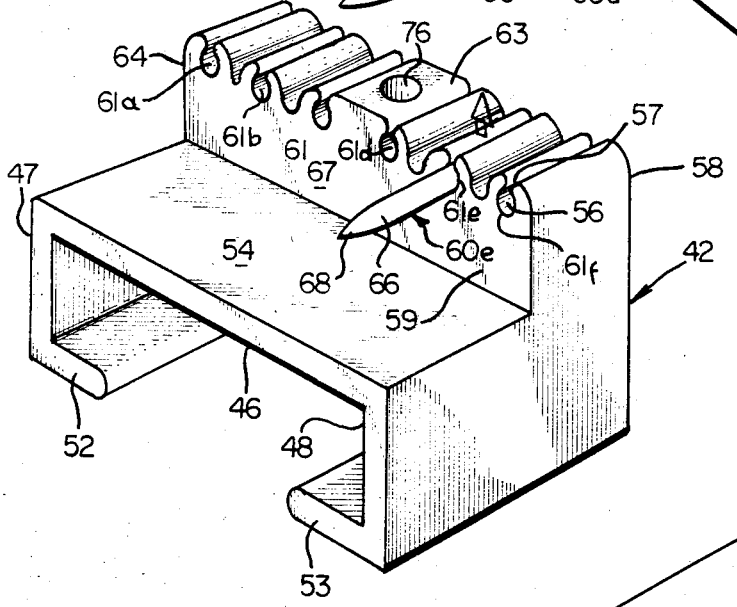
FIG. 4 is an enlarged, perspective view of one of the mounting members of the retaining device illustrated in FIG. 2 and showing one of the pin-like retainer members engaged in a slot in the mounting member and another of the retainer members positioned above a slot prior to insertion thereof into the mounting member.
Figure 4:
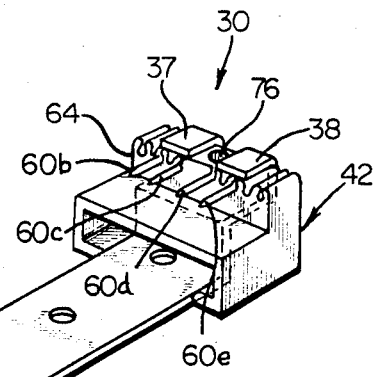

Referring now to FIG. 4 in conjunction with FIGS. 2 and 3, it will be seen that the retaining device 30 includes a pair of mounting members 42 and 43 carried at the respective ends of the support member or bar 32 and adapted to secure a book, such as the telephone directory 15, to the support member. Since the mounting members 42 and 43 are identical, only the mounting member 42 will be described in detail.

Figure 5:
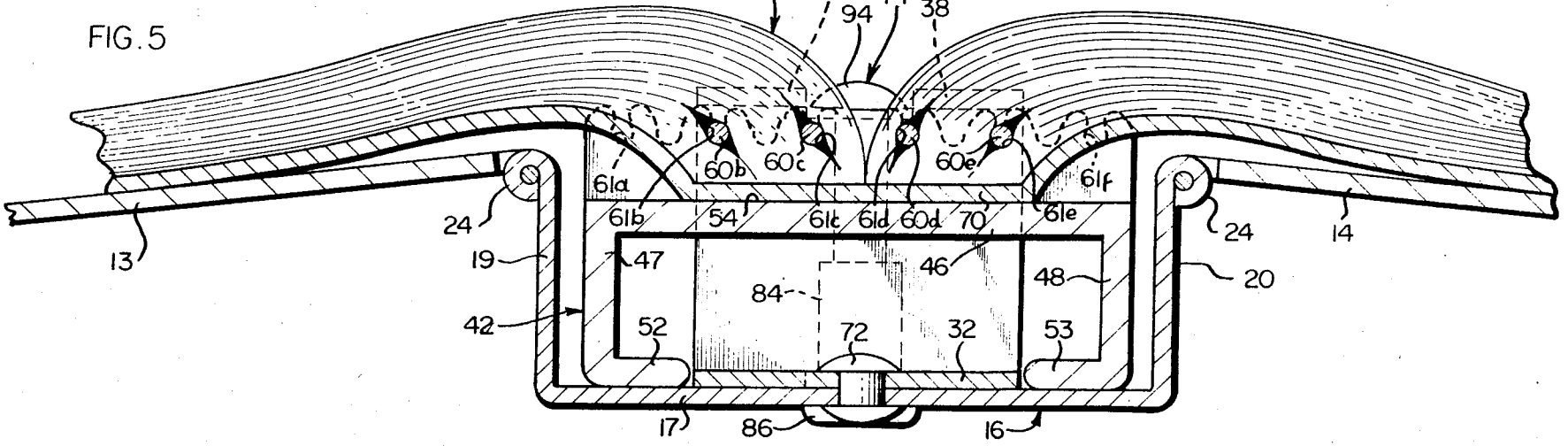
FIG. 5 is a broken, vertical sectional view taken along the line 5—5 of FIG. 3.

Referring now to FIGS. 3 and 5 in conjunction with FIG. 4, it will be seen that the mounting member 42 is generally in the shape of an inverted channel having a plate-like web portion 46, depending flange portions 47 and 48, and inturned guide portions 52 and 53, which are generally parallel to the web portion 46. The length of the flange portions 47 and 48 is such that the upper surface, indicated at 54 of the web portion 46 lies somewhat below the plane of the hinges 24 of the holder 10. If the device 30 is to be used to support a book on a flat surface, such as on a shelf, or the top of a table or cabinet, the length of the flange portions 47 and 48 could be substantially reduced or the flange portions 47 and 48, and possibly the support bar 32, could be completely eliminated.

The mounting member 42 is adapted to receive and releasably retain at least one and preferably a plurality of elongated, pin-like retainer members. To this end, the mounting member 42 includes an upstanding boss portion 64 disposed toward the longitudinally outer end of the member 42 and having at least one and preferably a plurality of laterally spaced, longitudinally extending recesses or slots, respectively indicated at 61*a*–61*f* in FIG. 4, formed in the upper surface, indicated at 63, of the boss portion 64. The slots 61*a*–61*f* are parallel to each other and extend lengthwise through the boss portion 64 with the outer and inner ends thereof extending into the outer and inner end faces, indicated at 58 and 59, respectively, of the boss portion. In addition, each of the slots 61*a*–61*f* includes a receiving portion at the bottom thereof, and an entrance portion which is connected to and smaller than the receiving portion and which opens in the upper surface 63 of the boss portion. The receiving portion of the slot 61*f* is indicated at 56 and the entrance portion is indicated at 57 in FIG. 4.

Each retainer member includes a cylindrical mounting portion 62 and a generally cylindrical engaging portion 66 having a pointed end 68 that facilitates insertion of the portion 66 into an end and between the pages of a closed or open book, such as the telephone directory 15. The diameter of the mounting portions 62 of each retainer member is preferably somewhat greater than the diameter of the engaging portion 66 to provide a shoulder for axially positioning and applying an axial force to the retainer member.

When the mounting portions 62 of one or more of the retainer members are mounted in receiving portions at the bottoms of the slots 61*a*–61*f*, the engaging portions 66 of the retainer members extend longitudinally inwardly from the inner end face 59 of the boss portion 64 with the axes of the retainer members generally parallel to the support bar 32.

Referring again to FIGS. 3 and 5 in conjunction with FIGS. 2 and 4, the manner in which the device 30 is used to releasably retain a book, such as the telephone directory 15, in the holder 10 is as follows:

Initially, the support bar 32 is secured to the inner surface of the web portion 17 of the back portion 16 of the holder 10, such as by rivets 72. Thereafter, an appropriate number of retainer members are engaged with one or more of the slots 61*a*–61*f* in the mounting members 42 and 43, depending upon the thickness of the book to be retained by the device 30. Such engagement is achieved by aligning the pointed ends 68 of the selected number of retainer members with the outer ends of selected ones of the slots 61*a*–61*f*, as indicated by the position of the retainer member 60*a* in FIG. 4, and then driving or pressing the retainer members axially inwardly into their respective slots. To this end, the diameter of the arcuate portions of the slots 61*a*–61*f* is preferably slightly smaller than the diameter of the mounting portions 62 of the retainer members. Consequently, the mounting portions 62 of the retainer members are frictionally retained in the slots 61*a*–61*f* by an interference fit. The material of at least the boss portion 64 of the mounting member 42 is such as to accommodate such a fit.

Assuming that the thickness of the telephone directory 15 to be engaged with the device 30 is such as will accommodate extension of four of the engaging portions 66 of the retainer members therein, four of the retainer members are pressed or driven into four of the adjoining slots in the boss portions 64 of the mounting members 42 and 43. In FIGS. 2 and 5, four retainer members, respectively indicated at 60*b*, 60*c*, 60*d*, and 60*e*, are shown mounted in the slots 61*b*, 61*c*, 61*d*, and 61*e* of the boss portion 64. A like number of the retainer members (not shown) are driven or pressed into corresponding slots in the mounting member 43. Thereafter, the mounting members 42 and 43 are engaged with the opposite ends of the telephone directory 15 by forcing the pointed ends 68 of the engaging portions 66 inwardly into the ends of the book until the end faces of the directory 15 engage or are disposed closely adjacent to the end faces 59 of the boss portions 64 of the mounting members 42 and 43. Insertion of the engaging portions 66 into the ends of the book is effected while the back, indicated at 70, of the directory 15 is engaged with the upper surface 54 of each mounting member.

In this regard, the length of the surface 54 is somewhat greater than that of the engaging portions 66 of the retainer members, when the latter are mounted in the slots 61*a*–61*f*, as shown in FIG. 3. Consequently, the surface 54 serves as a guide for the back of the telephone directory 15 while the mounting members 42 and 43 are being shifted into such substantial engagement with the end faces, indicated at 71, of the directory 15.

The greater length of the surface 54 of each of the mounting members 42 and 43 also acts as protection against finger contact with the pointed ends 68 of the retainer members.

When the mounting members 42 and 43 are thus engaged with their respective ends of the telephone directory 15, the mounting member 42 is shifted into engagement with the support bar 32 by moving the mounting member 42 toward the support bar 32 until the guide portions 52 and 53 straddle the support bar. Thereafter, the mounting member 42 and associated end of the telephone directory 15 are shifted toward the upwardly extending offset portion 36 of the end flange 33 until the outer end face 58 of the boss portion engages the offset portion 36 of the end flange 33 and the upper surface 63 of the boss portion 64 underlies the fingers 37 and 38.

As the mounting member 42 is being shifted into engagement with the end flange 33, the mounting member 43 is shifted downwardly into engagement with the end flange 34 with the outer end face 69 of the boss portion 64 engaging the inner side of the offset portion 39 of the end flange 34, as illustrated in FIG. 3.

After the mounting members 42 and 43 are fully engaged with their respective end flanges 33 and 34 on the support bar 32, as illustrated in FIG. 3, the mounting members are releasably secured to the support bar 32 by releasable locking means in the form of screws, indicated generally at 74 and 75. The shanks 79 of the screws 74 and 75 extend through bores 76 and 77 in the boss portions 64 of the mounting members 42 and 43, and through aligned bores 92 and 93 in the end flanges 33 and 34. The lower portions, indicated at 78, of the screws 74 and 75 are threaded and threadedly engage the interiors of the tubular portions, indicated at 83, of an anchor member 84. The lower ends, indicated at 86 of the anchor members 84 extend through openings 87 and 88 in the web portion 17 of the holder 10 so that the tubular portions 83 underlie and are coaxial with respective ones of the bores 92 and 93 in the end flanges 33 and 34.

In order to prevent casual removal of the screws 74 and 75 and hence unauthorized removal or theft of the telephone directory 15, the head, indicated at 94, of each of the screws 74 and 75 may be provided with a nonstandard recess to discourage casual removal of the screws and theft of the telephone directory.

Disengagement of the mounting members 42 and 43 from their engaged positions with the end flanges 33 and 34 may be rapidly and easily effected in the field by an authorized person having a tool or wrench capable of unthreading the screws 74 and 75 from the anchor members 84, and thereafter shifting the mounting members 42 and 43 outwardly away from the end flanges 33 and 34. Since the boss portion 64 of the mounting member 42 underlies the fingers 37 and 38, disengagement of the mounting member 42 is effected after disengagement of the mounting member 43. In some installations, the fingers 37 and 38 can be eliminated.

When it is desired to remove the retainer members from their operative, mounted positions in the slots 61*a*–61*f*, such removal may be conveniently accomplished by applying an upward force on the engaging portion 66 of each retainer member sufficient to cause the mounting portion 62 to pivot upwardly and out of its slot. The material of the boss portion 64 is sufficiently elastic to accommodate such movement.

Figure 6:
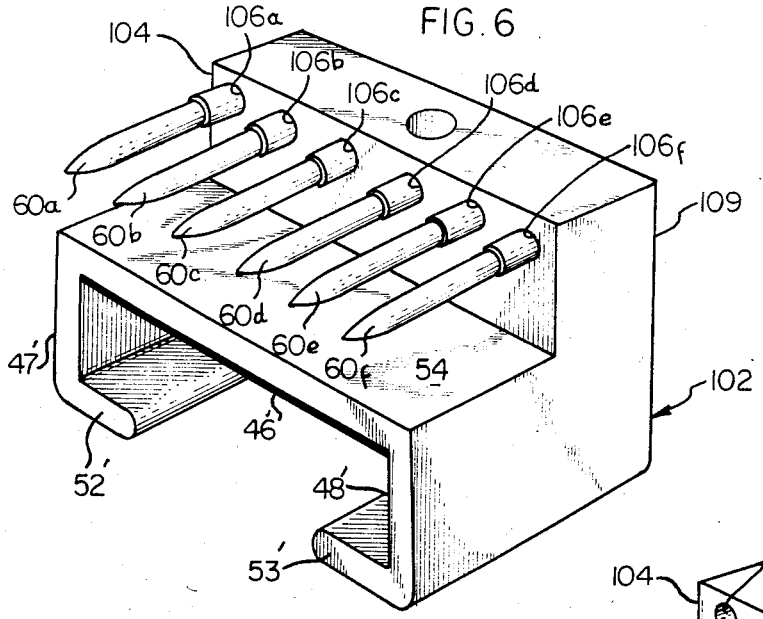
FIG. 6 is an enlarged, perspective view showing an alternate construction of one of the mounting members of the retaining device of the present invention.
Figure 7:
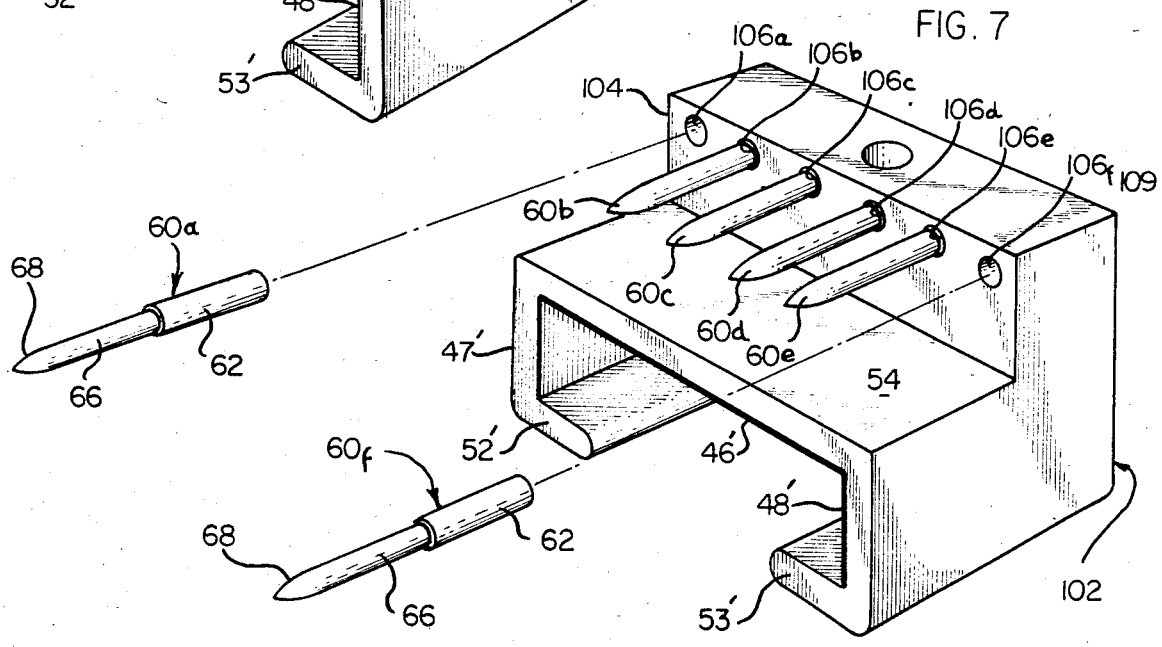
FIG. 7 is a view similar to FIG. 6 and showing the manner in which the pin-like retainer members may be engaged with or disengaged from the mounting member.

In FIGS. 6 and 7, an alternate construction, indicated generally at 102, for each of the mounting members 42 and 43 of the retaining device 30 is illustrated. The mounting member 102 also incorporates an alternate construction for releasably retaining one or more of the retainer members therein for holding a book, such as the telephone directory 15 illustrated in FIG. 1, engaged therewith. Since many of the structural features of the mounting member 102 are identical with those of the mounting members 42 and 43, like reference numerals indicated by prime numbers have been used to identify identical parts. It will be understood that a pair of the mounting members 102 are respectively engaged with the opposite ends of a book to be retained by the device 30.

The construction of the mounting members 102 is identical with that of the mounting members 42 and 43 in that each mounting member 102 is generally in the shape of an inverted channel having a plate-like web portion 46', depending flange portions 47' and 48', and inturned guide portions 52', 53', which are generally parallel to the web portion 46'. The function of the inverted, channel-shaped portion of the mounting member 102 is the same as that of the mounting members 42 and 43. Consequently, reference should be made in this specification to the description of this portion of the structure of the mounting member 42 for an understanding of the purpose and function of this same structure in the mounting member 102.

Each mounting member 102 is also adapted to receive and releasably retain at least one and preferably a plurality of the elongated, pin-like retainer members. To this end, the mounting member 102 includes an upstanding boss portion 104, which is disposed toward the longitudinally outer end of the channel-shaped section of the member 102 and having at least one and preferably a plurality of laterally spaced, longitudinally extending bores therein, respectively indicated at 106*a*–106*f* in FIGS. 6 and 7. The bores 106*a*–106*f* may extend completely through the boss portion 104 to terminate inwardly from the outer end face, indicated at 109, of the boss portion. In addition, the diameters of the bores 106*a*–106*f* are preferably somewhat smaller than the diameters of the mounting portions 62 of the retainer members so that the latter are frictionally retained in the bores with sufficient force to prevent casual removal thereof by a user of the book retaining device 30 when a pair of the mounting members 102 are utilized instead of the mounting members 42 and 43. However, the degree of frictional retention of the retainer members in the bores 106*a*–106*f* is such as to permit removal thereof from the boss portion 104 by a pliers or other suitable force applying tool.

According to the present invention, prior to engaging a pair of the mounting members 102 with a respective end of a book in an installation in the field, the mounting portions 62 of a plurality of the retainer members are partially inserted into the bores 106*a*–106*f*, as illustrated in FIG. 6. Such retainer members are indicated at 60*a*–60*f* in FIG. 6. Partial engagement of the retainer members in the bores 106*a*–106*f* facilitates removal of unnecessary ones of the retainer members, prior to inserting the engaging portions 66 of the remaining retainer members into the ends of a book. Assuming that a pair of the mounting members 102 are to be used instead of the mounting members 42 and 43, the device 30 is used to releasably retain a book, such as the telephone directory 15, in the holder 10, as follows:

Assuming that the support bar 32 has been secured to the inner surface of the web portion 17 of the back portion 16 of the holder 10, a determination is made by the installer as to the number of retainer members that will be required to extend into the ends of the book, such as the telephone directory 15, to provide the necessary degree of retention of the book. Assuming that only four of the retainer members are required, the installer would remove the two end retainer members 60*a* and 60*f* from the boss portion 104 of each mounting member 102, as indicated by the displaced positions of the retainer members 60*a* and 60*f* in FIG. 7. This is readily accomplished in the field by grasping and engaging portions 66 of the retainer members and applying sufficient force to pull the retainer members out of their mounting holes. Thereafter, inward force is applied to the engaging portions 66 of the remaining retainer members to shift them inwardly in their bores until the mounting portions 62 are substantially completely received in the mounting bores. When so positioned, the retainer members cannot be casually removed from their associated mounting members 102.

After the remaining retainer members are fully shifted into their bores, the engaging portions 66 thereof are inserted into the ends of the book to be retained by the device 30 in the same manner as the mounting members 42 and 43. Thereafter, engagement of the mounting members 102 with the support bar 32 is completed in the same manner as the mounting members 42 and 43.

Figure 8:
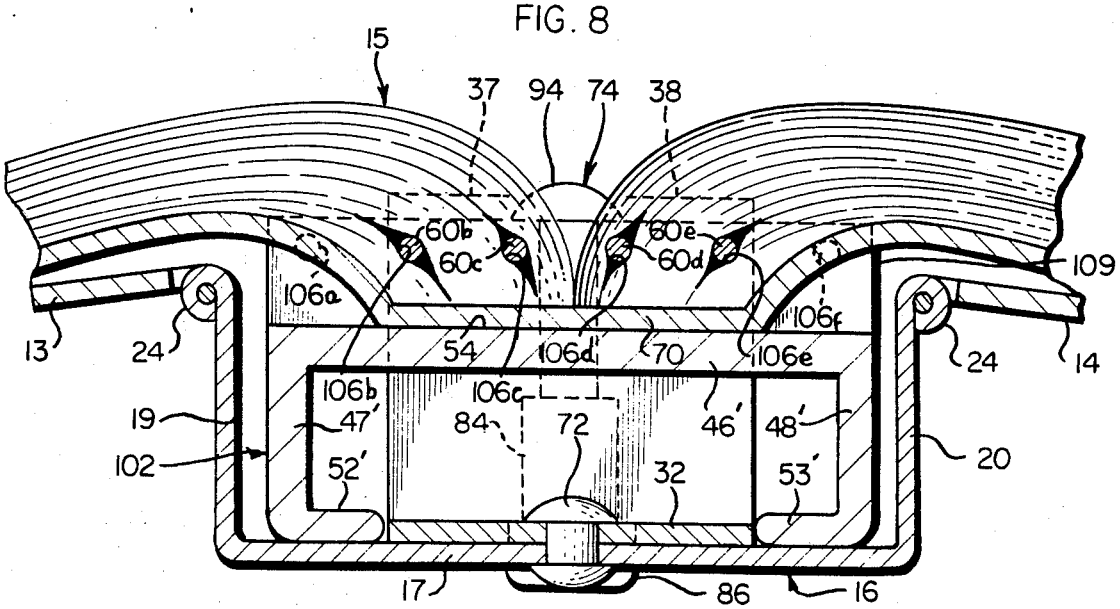
FIG. 8 is a view similar to FIG. 5 and showing the position of the retainer members of the mounting member illustrated in FIG. 7 as they would appear when operatively engaged with and disposed between the pages of a book.

FIG. 8 illustrates the approximate positions occupied by the retainer members 60*b*–60*e* when the latter are engaged with the ends of the telephone directory 15 and the mounting members 102 have been secured to the support bar 32 and web portions 17 of the the holder 10, as previously described.

It will be understood that the length of the flanges 47′, 48′ of the mounting member 102 could vary in accordance with the dimensions of an associated holder, such as the telephone directory holder 10, and that the flanges 47′ and 48′, and the support bar 32, could be completely eliminated if the mounting member 102 were to be used to secure a book to a flat surface, such as the top of a shelf or cabinet.

Figure 9:
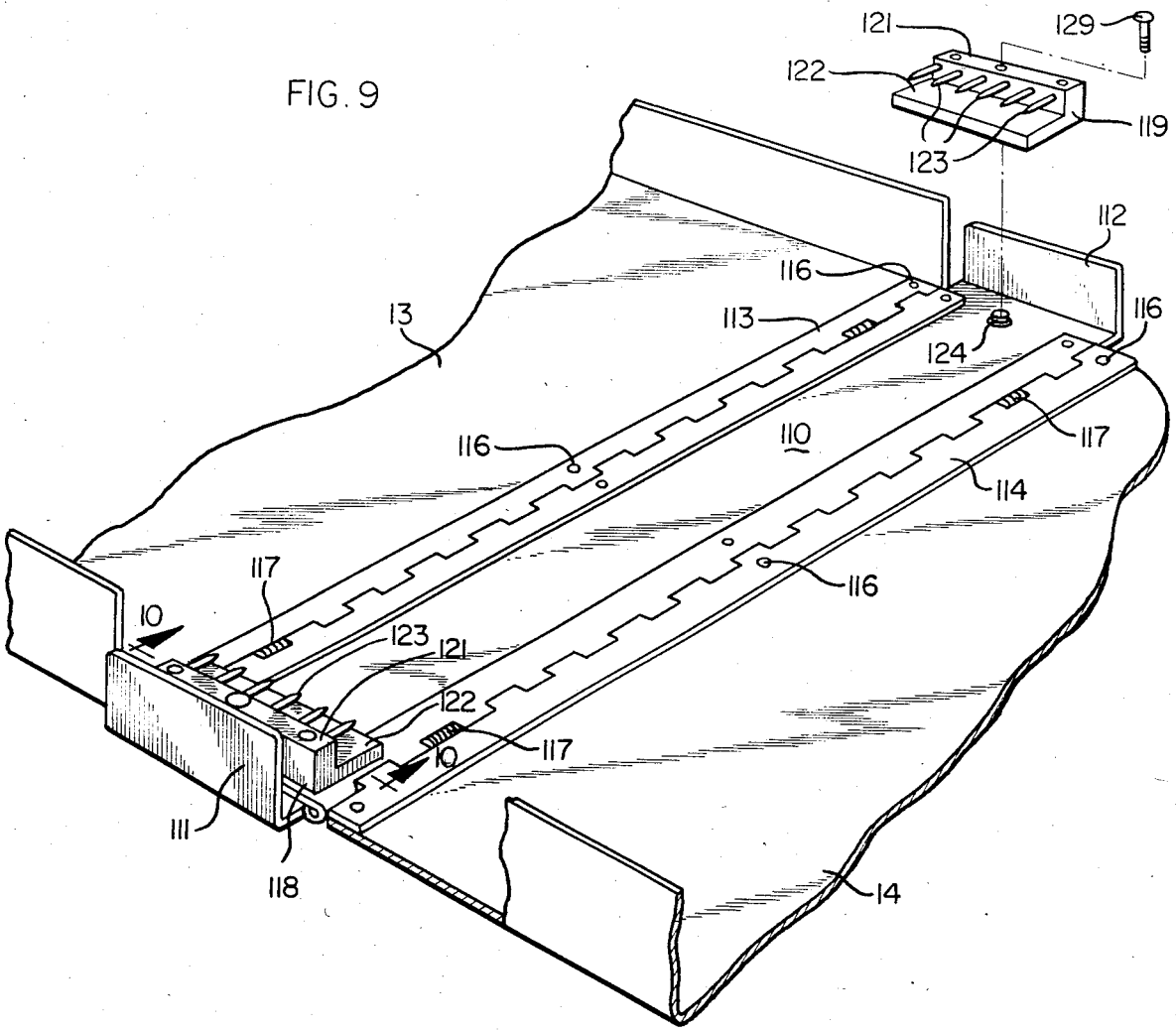
FIG. 9 is a fragmentary perspective view of another embodiment of the invention employing alternative support and mounting members.

In the embodiment shown in FIG. 9, support member or back plate 110 is an elongated flat strip provided with upstanding flanges 111 and 112 along its narrow ends. Covers 13 and 14 are attached to opposite side edges of back plate 110 by means of elongated piano-type hinges 113 and 114 and screws 116 (FIG. 10) which pass through plate 110 and engage threaded openings in the leaves of the hinges. In order to prevent unauthorized disassembly of the device, screws 116 are suitably provided with non-standard or tamperproof driving recesses (not shown). Hinges 113 and 114 are also optionally provided with coil springs 117 which bias covers 13 and 14 to the closed position. Affixed to both ends of back plate 110 and adjacent flanges 111 and 112, respectively, are a pair of mounting members 118 and 119, each of which comprises an upstanding boss portion 121 and an inwardly directed horizontal plate portion 122. Projecting inwardly from the upstanding boss portion 121 of mounting members 118 and 119 are a plurality of retaining members 123 similar to those used in the embodiment of FIG. 7, in a number appropriate to the thickness of the book or similar article to be retained. Centrally located in back plate 110 adjacent each of flanges 111 and 112 is an internally threaded upwardly projecting anchor member 124.

Figure 10:
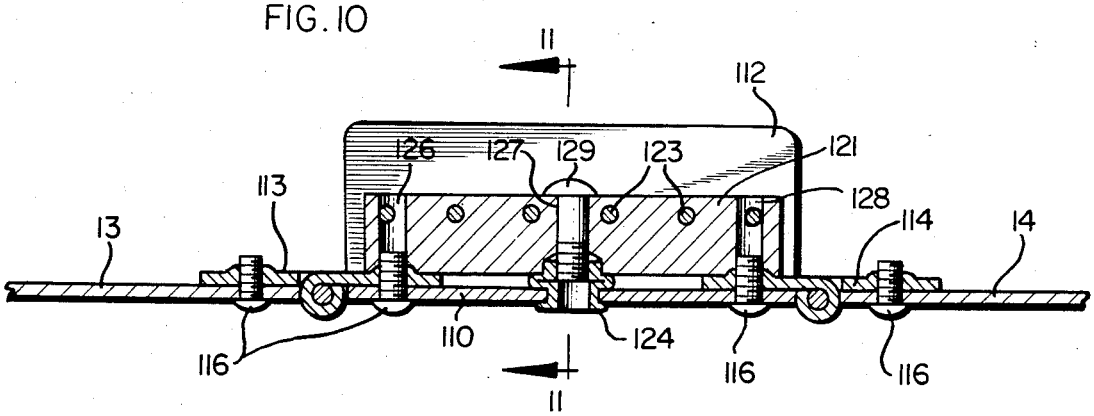
FIG. 10 is a sectional view along the line 10—10 of FIG. 9.
Figure 11:
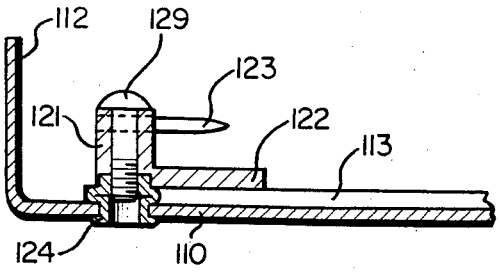
FIG. 11 is a sectional view along the line 11—11 of FIG. 10.

As shown in FIG. 10, each of the boss portions, e.g., 121, of each mounting member, e.g. 118, contains three vertical bores 125, 127 and 128 positioned to align with an anchor member, e.g., 124, and adjacent screws 116. The bottom section of each of the bores is relieved to accommodate the projecting ends of screws 116 and upstanding anchor member 124, thereby permitting the lower surface of the mounting member to rest flush on the upper surface of hinges 111 and 112. A security screw 129 inserted into the middle bore 127 of the mounting member engages anchor member 124 and affixes the mounting member to back plate 110, while the registration screw 116 with the relieved portions of the outer bores 126 and 128 prevents rotation of the mounting member relative to back plate 110.

The method of assembly of the embodiment of FIG. 9 to hold a telephone directory is similar to that previously described, as will be apparent to one skilled in the art.

In addition to the novel structural features of the retaining device 30, the present invention also contemplates a novel method of releasably retaining a book, such as the telephone directory 15, in a telephone directory holder, such as the holder 10, or on a flat surface, such as the upper surface of a shelf or table. Such method includes the steps of inserting one or more elongated, pin-like retainer members into recesses in a pair of mounting members, shifting the mounting members toward the ends of the book until the pin-like retainer members are disposed between the pages of the book, and securing the mounting members to the holder or a flat surface while the retainer members are disposed between the pages of the book.

The method herein disclosed further contemplates the additional steps of forming the recesses by providing a plurality of laterally spaced, longitudinally extending slots in each mounting member so that the extent of frictional retention of the retainer members in the slots is great enough to prevent casual disengagement of the retainer members from the slots when the mounting members are engaged with a book.

The method herein disclosed also contemplates the steps of forming the recesses by providing a plurality of laterally spaced, longitudinally extending bores in each of the mounting members of the device, partially inserting a retainer member in each bore, removing an appropriate number of the retainer members from each mounting member in accordance with the thickness of a book to be retained by the device, completely inserting the remaining retaining members into each mounting member, shifting the retainer members toward the respective ends of the book until the engaging portions of the retainer members extend between the pages of the book, and thereafter releasably securing the mounting members to a holder or flat surface while the retaining members are engaged therewith.

While one or more embodiments of the invention have been herein illustrated and described in detail, it will be understood that modifications and variations thereof may be effected without departing from the spirit of the invention and the scope of the appended claims.

What is claimed is:

1. A retaining device for a book, such as a telephone directory, said device comprising:

an elongated support member having opposite end portions, a pair of mounting members respectively carried on said opposite end portions of said support member, at least one elongated, retainer member carried by each of said mounting members, each retainer member having a mounting portion engaged with its associated mounting member and an engaging portion extending inwardly toward the other of said mounting members, said engaging portions being adapted to extend into the opposite ends of a book to be retained by said device and between an adjacent pair of pages of said book in generally close proximity to the back thereof, means for releasably securing said mounting members to said support member with the engaging portions of said retainer members extending into the opposite ends of said book, whereby said retaining member serves to releasably retain a book, such as a telephone directory, engaged with said holder so as to prevent unauthorized removal and/or theft of said book or telephone directory while permitting substantially unobstructed viewing of the pages thereof, each of said mounting members has at least one recess therein from receiving and releasably retaining the mounting portion of a retainer member, each of said mounting members has an upstanding boss portion, and said recesses are formed in said boss portion, said recesses comprise a plurality of slots in said boss portion, each of said boss portions has an upper surface and opposite end faces, each of said slots extends into the end faces of its associated boss portion and has a receiving portion sized to closely fit and frictionally retain the mounting portion of a retainer member, and at least said boss portions are of relatively rigid, yieldable material, whereby said retainer members are releasably retained in said boss portions by the interference fit of the mounting portions thereof in said receiving portions, said retainer members being insertable into and removable from said receiving portions by aligning the same with said receiving portions and applying sufficient force thereto to cause said retainer members to shift into said receiving portions.

2. The retaining device of claim 1, in which a plurality of said recesses are provided in each of said mounting members and a plurality of said retainer members are mounted in said recesses.

3. The retaining device of claim 2, in which said recesses are arranged to laterally spaced relation with the axes thereof extending parallel to said support member.

4. The retaining device of claim 1, in which said mounting portions are cylindrical and said receiving portions are substantially circular in cross section.

5. The retaining device of claim 1 or 4, in which each of said slots has an entrance portion that opens in the upper surface of its associated boss portion and is connected to said receiving portion, and said retainer members are removable from said slots by applying sufficient force to the engaging portions of said retainer members to cause the mounting portions thereof to shift through the entrance portions of said slots.

6. The retaining device of claim 1, in which each of said mounting members has an upstanding boss portion of relatively rigid, yieldable material and having longitudinally inner and outer side faces and an upper surface, and said recesses comprise a plurality of laterally spaced bores in said boss portions and extending inwardly from the inner side faces thereof.

7. The retaining device of claim 6, in which said mounting portions are cylindrical and said bores are circular in cross section, and the diameter of each of said bores is somewhat smaller than the diameter of each of said mounting portions, whereby said retainer members are releasably retained in said bores by the interference fit of the mounting portions thereof in said bores.

8. A retaining device in accordance with claim 1 in which said means of releasably securing said mounting members to said support members are security screws.

9. A retaining device in accordance with claim 1 in which said retainer members are pin-like in shape.

10. The method of releasably retaining a book, such as a telephone directory, on a flat surface, such as the elongated plate portion of a telephone directory holder, said method comprising the steps of inserting one or more elongated, pin-like retainer members in selected ones of a plurality of recesses in a pair of mounting members so that portions of the retainer members extend parallel to each other and outwardly from said mounting members, shifting said mounting members toward operative positions adjacent to or engaged with the ends of said book so that the pin-like retainer members extend into the ends and between pages of the book in generally closely spaced relation to the back thereof, securing said mounting members to said flat surface with said portions of said retainer members engaged with said book, inserting a sufficient number of said pin-like retainer members in said mounting members, prior to shifting the same into engagement with the ends of said book, so that the distance between the outermost ones of said retainer members is substantially equal to the width of the back of said book when said portions of retainer members, forming said pin-like retainer members with mounting portions and engaging portions adapted to extend into the ends of and between the pages of said book, providing said recesses by forming a plurality of laterally spaced slots in said mounting members with receiving portions of somewhat smaller size than the mounting portions of said pin-like retainer members, and, inserting said retainer members into said recesses by shifting the mounting portions thereof into said receiving portions.

11. The method of claim 10, which includes the additional steps of forming said slots with an entrance portion that is somewhat smaller than said receiving portion, and shifting the mounting portions of said retainer members through said entrance portions and into said receiving portions.

12. The method of claim 10, which includes the additional step of forming said pin-like retainer members with cylindrical mounting portions, providing said recesses by forming a plurality of laterally spaced bores in said mounting members with diameters somewhat smaller than the diameters of said mounting portions so that substantial force must be applied to the retainer members to effect removal thereof from said bores when the mounting portions of said retainer members are fully inserted into said bores.

13. The method of claim 12, which includes the additional steps of partially inserting the mounting portion of a retainer member in each of the bores in said mounting members prior to engaging said mounting members with said book, removing excess retainer members from said mounting members prior to shifting the mounting members into said operative positions, fully inserting the remaining retainer members into their bores, and thereafter shifting the mounting members into the operative positions adjacent to or engaged with the ends of the book.

* * * * *